US006116946A

United States Patent [19]

Lewis et al.

[11] Patent Number: 6,116,946

[45] Date of Patent: Sep. 12, 2000

[54] SURFACE MOUNTED MODULAR JACK WITH INTEGRATED MAGNETICS AND LEDS

[76] Inventors: Daniel Raymond Lewis, 774 Mays Blvd., #10, Incline, Nev. 89451; Robert James Lappin, 1828 Alpine St., Carson City, Nev. 89703; Chester Charles Egan, Jr., 1606 Candelwood St., Sparks, Nev. 89434

[21] Appl. No.: 09/123,223

[22] Filed: Jul. 27, 1998

[51] Int. Cl.[7] ..... H01R 3/00

[52] U.S. Cl. ..... 439/490; 439/676

[58] Field of Search ..... 439/490, 676, 439/79, 80

[56] References Cited

U.S. PATENT DOCUMENTS 5,700,157 12/1997 Chung ..... 439/490

*Primary Examiner*—Neil Abrams
*Assistant Examiner*—Javaid Nasri
*Attorney, Agent, or Firm*—Charles Hartman

[57] ABSTRACT

Telecommunications within networks are greatly facilitated by a modular telecommunication jack having LEDs and circuit board magnetics as an integral part. The modular jack of this invention can be easily surface mounted on a mother board. This invention also discloses a method of making su ch modular jacks.

10 Claims, 5 Drawing Sheets

SURFACE MOUNTED MODULAR JACK WITH INTEGRATED MAGNETICS AND LEDS

BACKGROUND OF THE INVENTION

1. Field of the Invention

This invention relates to modular jack connectors designed to be mounted on printed circuit boards; particularly, modular jack connectors having components for filtering common and differential noise; and more particularly, to modular jack connectors having filtering means and visual indicating means.

2. State of the Art

Electrical connectors, also known as modular telecommunications receptacles or jacks, have been known for many years. Although connectors of this general type were originally designed for use in telephone systems, they have found their way into wide acceptance in a variety of other contexts. For example, modular Jacks are now commercially used as input/output interface connectors for networking computers together.

These connectors are typically used for electrical connection between two computers or other networked devices. In order to ensure that a proper connection has been made and the link is established between devices or to ensure that the network is connected, indicators are frequently incorporated into the circuits on the printed circuit board. The most typical indicators used are light emitting diodes (hereinafter LEDs) which illuminate when an electric current passes. In telecommunication LEDs are used in networks to tell the technician if a connection has been established between two devices. LEDs can also indicate the existence of power to the board they are mounted on and so forth.

In an effort to decrease space used on the precious real estate of the circuit boards, more miniaturized magnetic components are used (hereinafter "the magnetics"). In order to facilitate the ease of installation and maintenance of these components, LEDs are frequently used in conjunction with the modular jack. More over, as technology of board and board mounting increases, the preferred way to mount most components is by direct surface mounting of the components onto the motherboard, thereby avoiding at least one step in the assembly of these devices.

SUMMARY OF THE INVENTION

This invention facilitates and provides the telecommunications devices and networks with a modular telecommunication jack having LEDs and circuit board magnetics as an integral part. The modular jack of this invention can be a easily surface mounted on a mother board. This invention also discloses a method of making such modular jacks.

A first aspect this invention provides a modular telecommunication jack comprising:

a bottom member having a top, a bottom, a front, a rear, a fist side and a second side, and including disposed within a dual-lead frame having a first plurality of contact electrodes extending sidewardly from the first side, and a second plurality of electrodes extending sidewardly from the second side, a third plurality of electrodes extending rearwardly, the bottom member defining a plurality of fitting receiving apertures and a first LED receiving slot having at least one of the first plurality of electrodes disposed therein and a second LED receiving slot having at least one of the second plurality of electrodes disposed therein, the first LED receiving slot and the second LED receiving slot defined in the bottom surface;

a top member having a top, a bottom, a front, a rear, and defining a central hollowed portion, and including a plurality of fitting receiving pegs received by the plurality of fitting receiving apertures;

a contact insert placed into and received by the central hollowed portion such that a plurality of bent contact leads extends downwardly from the top piece and a forth plurality of electrodes extends rearwardly from the top piece in substantially parallel orientation to the third plurality of electrodes;

a printed circuit board connected to the bottom member by the third plurality of electrodes and connected to the contact insert by the forth plurality of electrode, the third plurality of electrodes and the forth plurality of electrodes being oriented substantially perpendicularly to the plane of the circuit board, the circuit board having means to magnetically treat a signal, the signal having a first path of being received from the contact insert, being treated by the magnetic means on the circuit board, being received by the third electrodes and redirected to the first plurality of electrodes to a mother board, and a second path of being received by the second plurality of electrodes and being redirected to the third plurality of electrodes, being treated by the magnetic means on the circuit board, being received by the contact insert;

a rear cover member covering the circuit board and connected to the top member and the bottom member;

a first LED disposed in the first LED receiving slot and electrically connected to at least one of the first plurality of electrodes; and a second LED disposed in the second LED receiving slot and electrically connected to at least one of the second plurality of electrodes.

A second aspect of this invention is a method of manufacturing a telecommunications jack comprising;

placing a connector insert into a top piece;

mating the top member with a bottom member;

placing a printed circuit board which is electrically connected using high temperature soldering techniques and/or welding containing magnetic treatments over the leads of the connector jack and the leads of the bottom member;

soldering the circuit board to the connector insert and the bottom member, using a high temperature solder process;

placing a rear covering over the soldered circuit board;

injecting epoxy into the interstitial apace between the circuit board and the mated top and bottom members, and between the circuit board and the rear cover.

DETAILED DESCRIPTION OF THE PREFERRED EMBODIMENT

Figure 1:
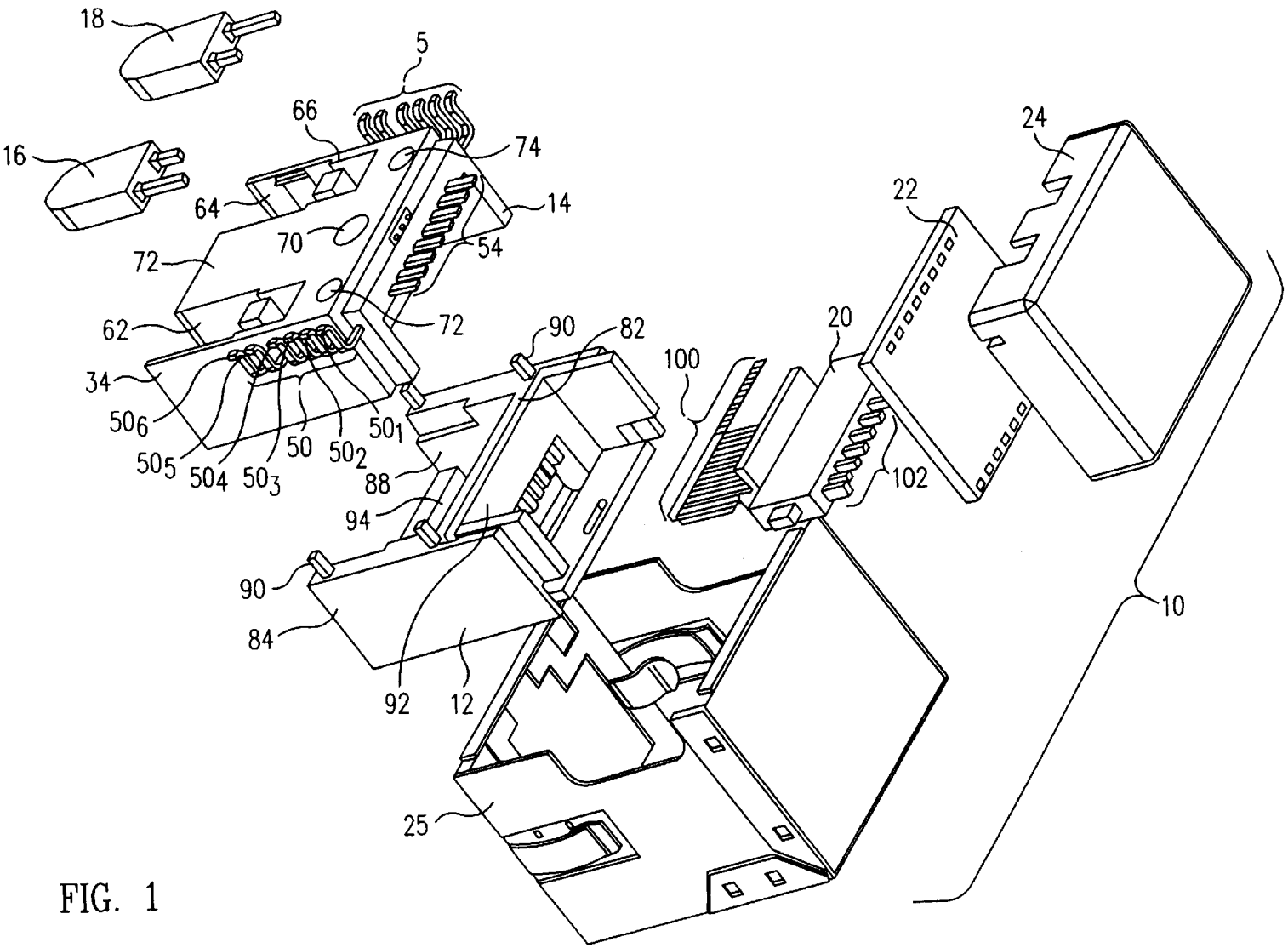
FIG. 1 shows an exploded perspective view of the modular telecommunications jack of this invention in an up-side down orientation.

Referring now to FIG. 1, a modular telecommunication jack, useful, for example, in 10 for 10/100 Base Ethernet applications includes a top member 12, a bottom member 14, a first LED 16, a second LED 18, a contact lead 20, a circuit board 22 and a rear cover 24. A conventional metal sheath 25 covers the entire assembled apparatus. As shown in FIG. 1, for ease of viewing the components, the modular jack is in an up-side down orientation compared to how it would normally be mounted on a telecommunications mother board, assuming that the conventional view would have the mother board in the down orientation. The mother board would be used, for example in a Personal Computer to interconnect that computer to either a local or a wide area network of computers.

Figure 2:
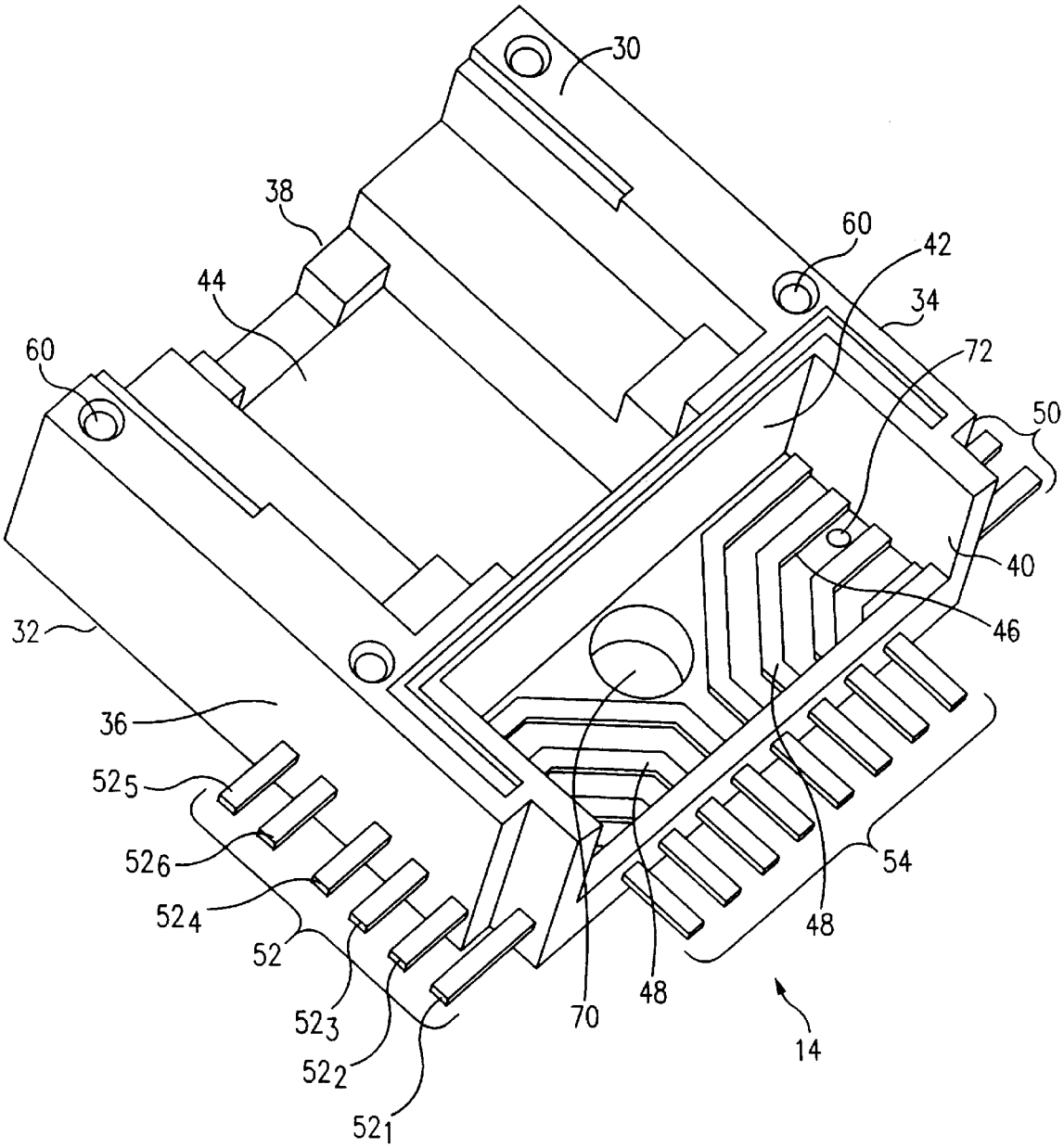
FIG. 2 shows a perspective view of the bottom member of the telecommunication jack of this invention from a top view.

Referring to FIG. 2, the bottom member 14 has a top 30, a bottom 32, a front 38, a rear 40, a fist side 34 and a second side 36. A center barrier 42 separates the jack plug-in portion 44 of the bottom member from the circuit board portion 46 of the bottom member. Disposed within the bottom member is a dual-lead frame 48 having a first plurality 50 of contact electrodes extending sidewardly from the first side, and a second plurality of electrodes 52 extending sidewardly from the second side, a third plurality 54 electrodes extending rearwardly. The first plurality of contact electrodes include a first sub-plurality $\mathbf{50}_1$, $\mathbf{50}_2$, $\mathbf{50}_3$, and $\mathbf{50}_4$ of electrodes that are in electric communication with the circuit board and a second plurality of electrodes $\mathbf{50}_5$ and $\mathbf{50}_6$ that are connected to a first LED 16. Similarly, the second plurality of contact electrode include a sub-plurality $\mathbf{52}_1$, $\mathbf{52}_2$, $\mathbf{52}_3$, and $\mathbf{52}_4$ that are in electric communication with the circuit board and a second sub-plurality of electrodes $\mathbf{52}_5$, and $\mathbf{52}_6$ that are connected to a second LED 18.

The bottom member defines, on its top, a plurality of fitting receiving apertures 60 and, on its bottom, a first LED receiving slot 62 and a second LED receiving slot 64. As shown in FIG. 1, each LED receiving slot has an LED securing detent 66 molded onto the bottom of the LED receiving slot and at least one of the second sub-plurality of the first plurality of electrodes $\mathbf{50}_5$ and $\mathbf{50}_6$, available for electric contact with the first LED and second LED. The bottom member also defines a first potting aperture 70, a second aperture 72, and a third aperture 74. The first potting aperture 70 is the conduit for epoxy into the body of the fully assembled modular jack (shown in FIG. 5) and the second aperture 72 and the third aperture 74 are vents for the epoxy loading operation.

In FIG. 1, the first LED 16 (shown in exploded orientation for clarity in FIG. 1) is disposed over the first LED receiving slot 62. When connected, it will be electrically connected to at least one of the first plurality of electrodes $\mathbf{50}_5$ and $\mathbf{50}_6$, and, similarly, the second LED (shown in exploded orientation for clarity in FIG. 1) will, in the finished product, be disposed in the second LED receiving slot 64 and electrically connected to at least one of the second plurality of electrodes $\mathbf{52}_5$, and $\mathbf{52}_6$. Although in the present invention, it is preferred to used detents to secure a press fit LED into the LED receiving slot, it will of course be readily appreciated that the LEDs can be mounted on the bottom member using a variety of conventional techniques, including press fitting, or the use of adhesives, for example, epoxies and the like.

When the first and second LEDs are mounted in the bottom member the bottom surface of the bottom member is substantially a planar surface, although because in the preferred embodiment the LEDs are secured to the bottom member by the detent, the surface of the LEDs will be slightly depressed from the bottom surface of the bottom member. The finished modular jack can be attached directly to the mother board using surface mounting technology. Adhesives and/or solder may be used in different applications depending on the size, the function and the temperature sensitivity of the finished jack. This is in contrast to the conventional modular jack mounting where the jack is plugged into the mother board and the ends of the leads that extend through the mother board are wave soldered. It will be seen that the mounting, adhering surface of the finished modular jack of this invention includes electrical connecting surfaces from both the bottom member and the LEDs.

Figure 3:
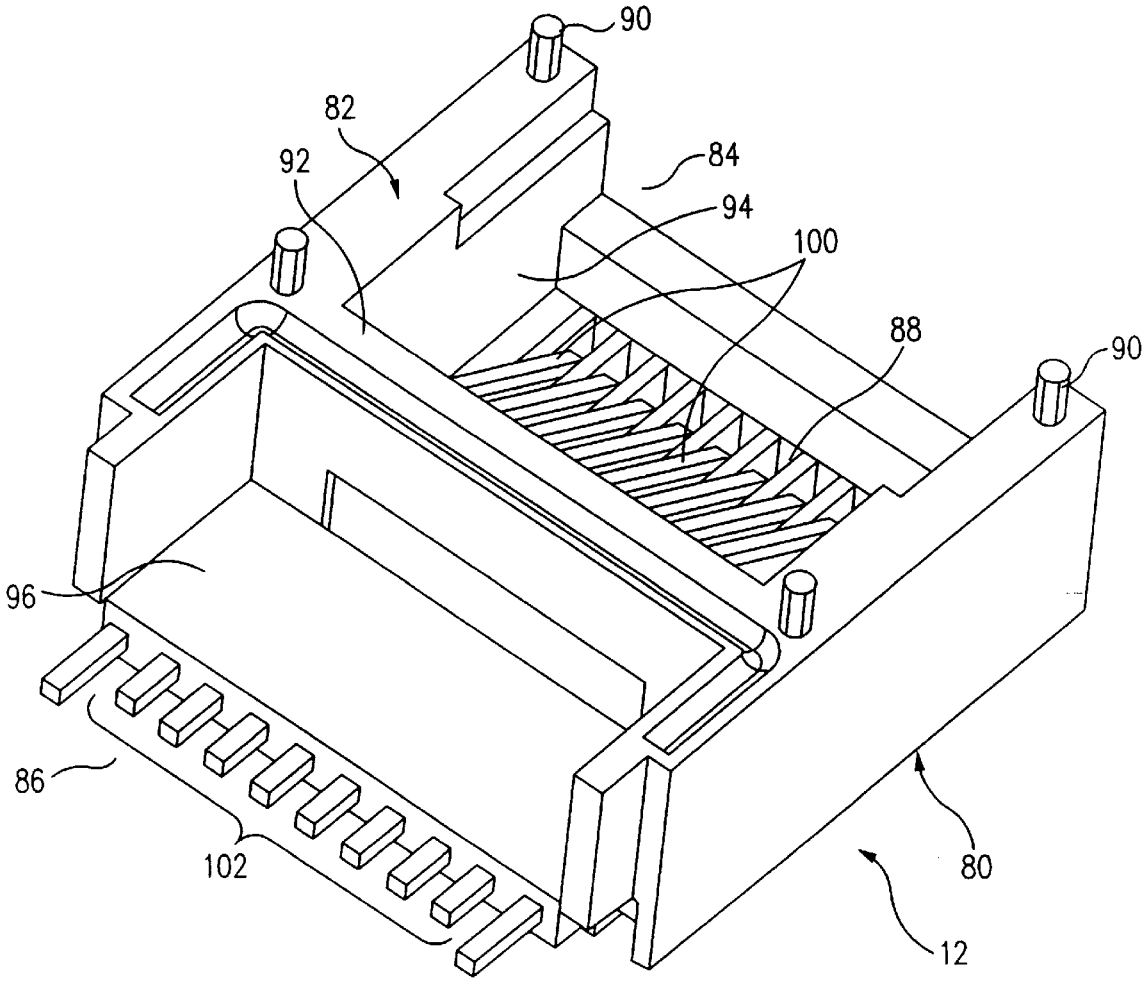
FIG. 3 shows a perspective view of the top member of this invention shown with the contact insert piece installed and in place within the top member.

Referring now to FIG. 3, the top member 14 has a top surface 80, a bottom surface (or surfaces) 82, a front 84, a rear 86, with the body of the top member defining a central hollowed portion 88. On the bottom 82 of the top member a plurality of fitting receiving pegs 90 are disposed to be received by the plurality of fitting receiving apertures 60 in the bottom member 12. A center barrier 92 separates the jack portion of the top member 94 from the circuit board portion 96 of the top member. It will be seen that the contact piece 20 penetrates the center barrier 92 to allow the fourth leads 102 to extend to the circuit board 22, and forms an unbroken center divider. The jack leads 100 are disposed for easy engagement with an inserted jack member or plug. When the top member and the bottom member are attached, the center barrier formed is complete and unbroken and the jack insertion portion of the modular jack and the circuit board section of the modular jack are completely isolated.

A contact insert providing conventional plug contacting points 20 placed into and received by the central hollowed portion 88 allows the modular jack of this invention to be used in conventional applications and with conventional telecommunications cable terminating plugs. The contact piece has a plurality of bent contact leads extends downwardly from the top piece and a forth plurality of electrodes extends rearwardly from the top piece in substantially parallel orientation to the third plurality of electrodes.

As shown in FIG. 3, once the contact insert is disposed in the top member the fourth plurality 102 of leads extends rearwardly out near the top of the top member to contact the circuit board 22.

A printed circuit board with magnetic treatments of various sorts is connected to the bottom member 12 by the third plurality of electrodes 54 and connected to the contact insert 20 by the forth plurality of electrodes 102, the third plurality of electrodes 54 and the forth plurality of electrodes 102 being oriented substantially perpendicularly to the plane of the circuit board.

Figure 4:
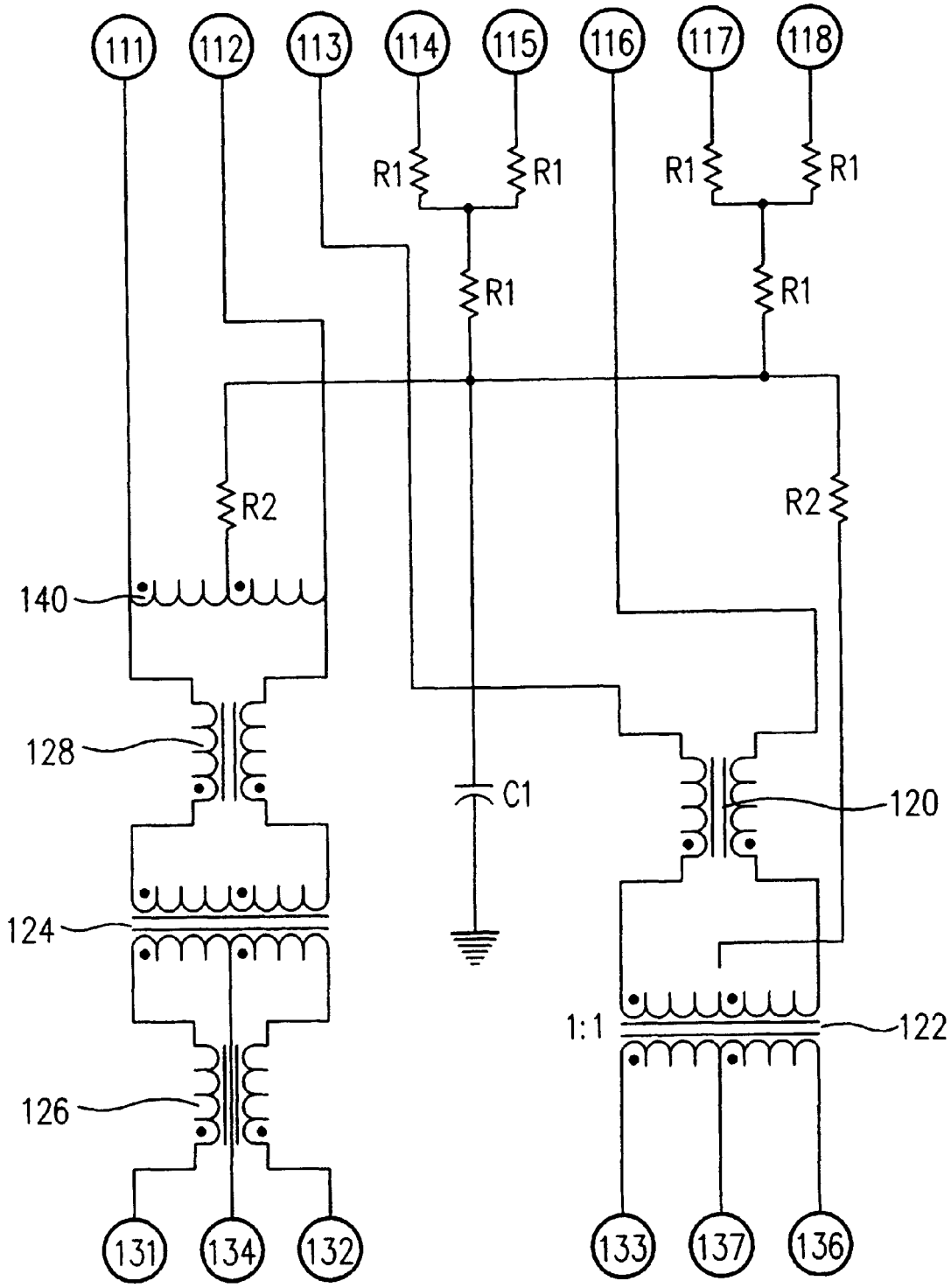
FIG. 4 shows a schematic diagram of the electronic circuit board of this invention.

Referring to FIG. 4, the signal has a first path of being received from the contact insert from an external signal, and then being routed to the circuit board where it is treated by the magnetic means on the circuit board. The remotely generated signal is received by the electrodes 113 and 116 of the circuit board. The incoming signal is first processed by common mode choke 120 and then processed across an isolator 122 before being presented to electrodes 133, 137, and 136 for processing by the host system. Similarly, the signal generated by the host system is received by electrodes 131, 132, and 134, and is processed across a common mode choke 126, and then across an isolator 124. The chokes and the isolators comprise the magnetics of this invention. The signal is then processed by a second common mode choke 128. The final magnet processing is a balancing center top auto-transformer 140 (used primarily to achieve the greatest degree of balance possible) before the signal exits to the remote network through leads 111 and 112. The treated signal is then received by the third electrodes and redirected to the first plurality of electrodes to a mother board and the internal electric connections. A similar second path allows signals generated internally to be received by the second plurality of electrodes, then to the third plurality of electrodes, once more through the circuit board, and finally being received by the contact insert. The circuitry is fairly conventional, being defined by various governmental and industry standards, but it should be noted that the circuitry could be quite different, and for various applications and the modular jack with this different circuitry still be with in the scope of this invention.

The method of this invention also provides a method of manufacturing the modular telecommunications jack described. The assembly is accomplished by first placing a connector insert into a top piece, then mating the top member with a bottom member by aligning the receiving pegs and the apertures that mate with the receiving pegs. In the preferred embodiment, the top member and the bottom member are press fit together, but adhesives, ultrasonic bonding or the like could be used.

Then a previously finished circuit board is placed in soldering orientation with the third plurality of leads and the fourth plurality of leads. In instances where the magnetics and/or other components are soldered onto the circuit board, it is preferred to use a high temperature solder, usually a 10/90 tin-lead alloy solder, to solder the components onto the circuit board, as well as to solder the finished circuit board to the third and fourth plurality of leads. Alternatively, the component leads may be welded onto the circuit board. Then the end user can use a lower temperature solder, usually a 63/37 tin-lead solder, and typical surface-mount solder reflow processes to affix the assembled connector to the Motherboard. This ensures that the electrical connections within the connector will withstand the end user's reflow solder process without damage or degradation. Of course other conventional technology, such as conductive epoxy, can be used to affix the finished connector to the end-application Motherboard.

The rear cover of the modular jack is then placed over the circuit board and connects the mated top member and bottom member. The gaps between the circuit board are filled with injected epoxy, injected though the first injection aperture and the second injection aperture.

Figure 5:
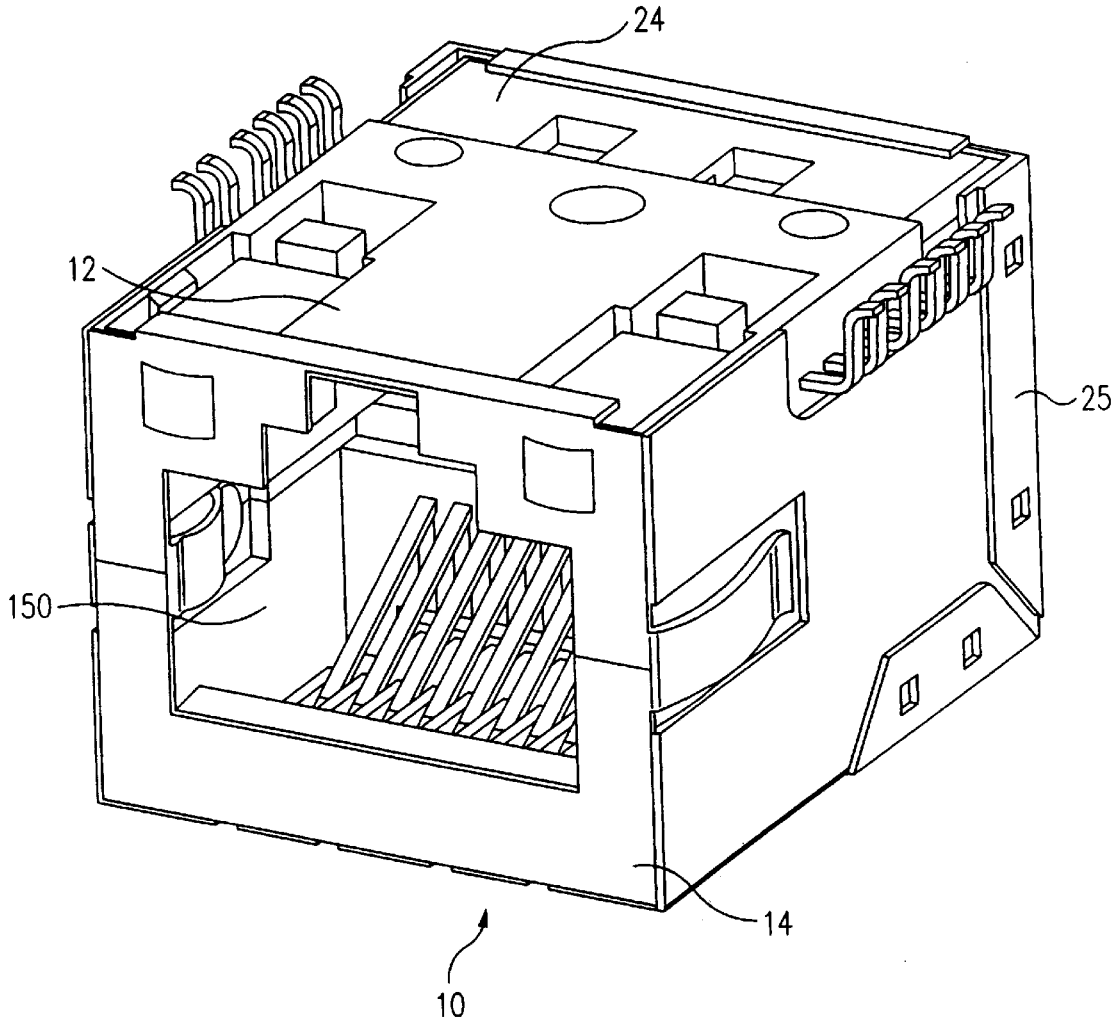
FIG. 5 shows a perspective view of the assembled modular telecommunications jack of this invention from a bottom view.

Referring to FIG. 5, the assembled modular jack 10 (shown, again, upside down compared to the conventional depiction of the mother board on the bottom) has defined an aperture 150 between the junction of the top member and the junction of the bottom member. Conventional telecommunications cable plugs, for example those conforming to the RJ45 10/100 base modules standard, can now be inserted into the aperture and the jack will receive the plug, and process the remote signals the plug presents to it. The rear cover 24 of the modular jack allows a secure attachment of the top 14 and bottom 12 piece. The fully assembled piece includes a metal cover or sheath 25, which among other things acts as an electromagnetic shield and local ground reference for the modular jack assembly. This metal cover is an entirely conventional addition, and is necessary before the assembled modular jack is mounted on a mother board.

The assembled modular jack with the metal jacket is then suitable for surface mounting on the motherboard. The modular jack of this invention can be surface mounted by soldering it to the board or by alternative methods such as the use of adhesives, such as conductive epoxies and the like.

This invention has been described with reference to particular embodiments and examples thereof. It will be readily apparent to one of ordinary skill in the art that one can modify, alter, and otherwise change the details of the invention without straying from the spirit of the invention. Therefore, the scope of the appended claims is intended to encompass all such modifications, alterations, and changes.

We claim:

1. A modular telecommunication jack comprising:

a body member having:

a bottom member having a top, a bottom, a front, a rear, a first side and a second side, a central barrier, and including disposed within a dual-lead frame having a first plurality of contact electrodes extending sidewardly from the first side, and a second plurality of contact electrodes extending sidewardly from the second side, a third plurality of contact electrodes extending rearwardly, the bottom member defining a plurality of fitting receiving apertures and a first LED receiving slot having at least one of the first plurality of contact electrodes disposed therein and a second LED receiving slot having at least one of the second plurality of contact electrodes disposed therein, the first LED receiving slot and the second LED receiving slot defined in the bottom;

a top member having a top, a bottom, a front, a rear, a central barrier, and defining a central hollowed portion, and including a plurality of fitting receiving pegs received by the plurality of fitting receiving apertures;

a contact insert placed into and received by the central hollowed portion such that a plurality of bent contact leads extends downwardly from the top member and a fourth plurality of contact electrodes extends rearwardly from the top member in substantially parallel orientation to the third plurality of contact electrodes;

a printed circuit board connected to the bottom member by the third plurality of contact electrodes and connected to the contact insert by the fourth plurality of contact electrodes, the third plurality of contact electrodes and the fourth plurality of contact electrodes being oriented substantially perpendicularly to the plane of the circuit board, the circuit board having means to magnetically treat a signal, the signal having a first path of being received from the contact insert, being treated by the magnetic means on the circuit board, being received by the third plurality of contact electrodes and redirected to the first plurality of contact electrodes to a motherboard, and a second path being received by the second plurality of contact electrodes and being redirected to the third plurality of contact electrodes, being treated by the magnetic means on the circuit board, being received by the contact insert;

a rear cover member covering the circuit board and connected to the top member and the bottom member;

a first LED disposed in the first LED receiving slot and electrically connected to at least one of the first plurality of contact electrodes; and a second LED disposed in the second LED receiving slot and electrically connected to at least one of the second pluurality of contact electrodes.

2. The modular telecommunications jack of claim 1 wherein the body member includes a metal housing.

3. The modular telecommunications jack of claim 1 wherein the first LED and the second LED are mounted to be seen from a front surface of the jack when the jack is mounted on the motherboard.

4. The telecommunications jack of claim 1 wherein the jack is surface mountable onto the motherboard.

5. The telecommunications jack of claim 1 wherein a first solder used for connecting components to the circuit board, and for connecting the circuit board to the third and fourth pluralities of contact electrodes has a higher melting temperature than a second solder used for connecting the finished jack to the motherboard.

6. The telecommunications jack of claim 1 wherein the top member is press fit into the bottom member.

7. The telecommunications jack of claim 1 wherein a first interstitial space between the circuit board and a barrier formed by the central barrier of the top member and the central barrier of the bottom member when the top member and the bottom member are mated is filled with inert material.

8. The telecommunications jack of claim 7 wherein the inert material is epoxy.

9. The telecommunications jack of claim 1 wherein a second interstitial space formed between the circuit board and the rear cover member is filled with inert material.

10. The telecommunications jack of claim 9 wherein the inert material is epoxy.

* * * * *